US007651728B2

(12) United States Patent
Payne et al.

(10) Patent No.: US 7,651,728 B2
(45) Date of Patent: Jan. 26, 2010

(54) METHOD FOR MANUFACTURING PAPERMACHINE CLOTHING

(75) Inventors: Justin A. Payne, Blackburn (GB); John Jeffery, Blackburn (GB); David S. Ponton, Blackburn (GB)

(73) Assignee: Voith Patent GmbH, Heidenheim (DE)

( * ) Notice: Subject to any disclaimer, the term of this patent is extended or adjusted under 35 U.S.C. 154(b) by 34 days.

(21) Appl. No.: 11/935,682

(22) Filed: Nov. 6, 2007

(65) Prior Publication Data

US 2008/0131652 A1 Jun. 5, 2008

(30) Foreign Application Priority Data

Dec. 5, 2006 (DE) ..... 10 2006 057 228

(51) Int. Cl.
*B05D 5/10* (2006.01)

(52) U.S. Cl. ..... 427/207.1; 427/288; 427/289

(58) Field of Classification Search ..... 427/207.1, 427/288, 289

See application file for complete search history.

(56) References Cited

U.S. PATENT DOCUMENTS

| | | | | |
|---|---|---|---|---|
| 5,876,784 | A * | 3/1999 | Hesselmann | 427/8 |
| 6,334,855 | B2 * | 1/2002 | Edenbaum et al. | 602/6 |

FOREIGN PATENT DOCUMENTS

| | | | |
|---|---|---|---|
| EP | 0 695 827 | * | 2/1996 |
| EP | 1690982 | | 11/2005 |
| EP | 0 695 827 | A2 | 7/2006 |
| EP | 1690981 | | 8/2006 |
| WO | WO/2004061213 | | 7/2004 |

* cited by examiner

*Primary Examiner*—Frederick J Parker
(74) *Attorney, Agent, or Firm*—Taylor & Aust, P.C.

(57) ABSTRACT

A method for manufacturing a fabric-like clothing, in particular for a machine for producing web material, in particular paper or paperboard, including the measures: a) providing a fabric-like substrate with at least one seam region extending essentially in the substrate transverse direction (CMD); b) applying a coating onto the fabric-like substrate such that the coating extends over at least one seam region; and c) cutting through the coating along at least one seam region.

11 Claims, 1 Drawing Sheet

METHOD FOR MANUFACTURING PAPERMACHINE CLOTHING

BACKGROUND OF THE INVENTION

1. Field of the Invention

This invention relates to a method for manufacturing a fabric-like clothing for a machine for producing web material, in particular paper or paperboard. Also this invention relates to a method with which such a fabric-like clothing can be incorporated into a machine for producing web material and to a fabric-like clothing for a machine for producing web material.

2. Description of the Related Art

On machines for producing web material, for example machines for producing paper or paperboard, use is made in various regions of elongated, endlessly working belts or clothing which have the function of transporting the web material to be produced or/and processing said material, including in particular dewatering it in press sections. For this purpose use is often made of belts or clothing with fabric-like substrates which have an open, meaning porous structure. Spiral link fabrics (also known simply as spiral fabrics) have proven particularly advantageous in this case. To be able to influence the surface properties and/or permeability locally it is known to apply a coating with a continuous or discrete pattern onto or into such a fabric-like structure.

For example, EP 1 690 981 A1 proposes applying such a coating in the form of a topographical pattern by using a rotary screen to create the pattern with the required form and quality.

EP 1 690 982 A1 proposes creating a topographical pattern by applying it in a polymer extrusion process, whereby an extrusion head for dispensing the polymer material is moved over the surface of the fabric-like substrate and applies thereby the pattern with the required form.

WO 2004/061213 discloses a method for producing an endless belt which is coated or impregnated with coating material and can be used in press sections of a paper machine. The polymer coating material is applied in all three spatial directions with the required structure.

The use of this approach known from the prior art is problematic when the clothing to be coated works in an endless configuration on a paper machine or the like but is not manufactured in an endless configuration and has at least one seam region. At such a seam region it is possible for the two end regions of the clothing situated there to be detached from each other in order for the open clothing, meaning the clothing no longer in an endless configuration, to be installed onto a paper machine or the like. After installation is completed, the two end regions are joined together again, for example by way of an elongated fastener. This means that it must still be possible to separate the two end regions even when provision is made for coating material on the substrate of the clothing. Generally this means that the pattern of the coating has to be selected such that it leaves the seam region uncovered in order for it to be possible for the end regions there to separated from each other and joined together again.

What is needed in the art is a method for manufacturing a fabric-like clothing for a machine for producing web material, in particular paper or paperboard, with which any coating pattern can be created even on a fabric-like substrate with at least one seam region.

SUMMARY OF THE INVENTION

The present invention provides a method for manufacturing a fabric-like clothing, in particular for a machine for producing a web of fibrous material, in particular paper or paperboard, including the following measures:

a) providing a fabric-like substrate with at least one seam region extending essentially in the substrate transverse direction;
b) applying a coating onto the fabric-like substrate such that the coating extends over at least one seam region; and
c) cutting through the coating along at least one seam region.

Hence with the inventive approach the coating is cut through after it is applied onto the fabric-like structure and possibly hardened, the cut being made where the fabric-like substrate may need to be separated in order to be able to incorporate the fabric-like clothing thus manufactured into a machine for producing web material. Hence it is possible with measure b) to apply the coating with any pattern and above all for said pattern to extend also over the seam region. There is no need to make sure that the seam region remains uncovered. This is an advantage because when a fabric-like clothing thus manufactured is used, there is no interruption of the coating in the seam region to create a structuring also in the web material to be produced. This is owed in particular to the fact that cutting through the coating in the seam region results in a configuration on which, after opening and reclosing the seam region, the directly adjacent regions of the separate coating are as though they were really not separated.

The coating can be made of polymer material for example and can be applied in a continuous or/and discrete coating pattern onto the fabric-like substrate. Totally regardless of the structure with which said pattern is constructed, it can be passed in any manner over the at least one seam region.

To be able to obtain a stable connection to the fabric-like substrate as well as the required effect, for example influencing of the permeability, it is proposed that the coating penetrates the fabric-like substrate with a penetrating depth of 5% to 100%.

On the fabric-like substrate used in the inventive method it is possible for example to provide for the seam region to include, in the end regions of the fabric-like substrate lying in the seam region, mutually overlapping loops through which an elongated fastener extending essentially in the substrate transverse direction is passed in order to join the two end regions. To achieve this, the fabric-like substrate can be constructed in many different ways. For example it can be constructed as a spiral link fabric or as a woven fabric. On spiral link fabric as well as woven fabric there are fastening loops in the end regions, said loops being formed either by fabric loops or by loop-like regions of the spiral links.

Measure c) can include cutting through the coating along the elongated fastener. To be able to do this with high precision it is proposed for the path of the elongated fastener to be recorded optically and for a cutting apparatus to be guided along the elongated fastener on the basis of the optical record.

The current invention applies also to a method for installing an inventively manufactured fabric-like clothing onto a machine for producing a web of fibrous material, the method including the following measures:

A) removing an elongated fastener from a seam region of the fabric-like substrate;
B) incorporating the open clothing into a machine for producing web material; and
C) closing the seam region by inserting an elongated fastener into the mutually overlapping loops in the end regions of the fabric-like substrate which are to be joined together.

To be able to intensify further the desired effect with the inventive fabric-like clothing, namely a practically non-existent interruption of the coating in a seam region, it is proposed in addition for the method to include a measure D) for rejoining the coating in the region of at least one seam region after performing the measure C). This rejoining can be performed for example by gluing, melting or ultrasonic welding of the cut coating.

According to another aspect the current invention relates to a fabric-like clothing, in particular for a machine for producing a web of fibrous material, in particular paper or paperboard, including a fabric-like substrate with at least one seam region extending essentially in a substrate transverse direction, on which end regions of the fabric-like substrate are or are to be joined together by an elongated fastener passed through mutually overlapping loops of the end regions, wherein provision is made on the fabric-like substrate for a coating which extends over at least one seam region and is cut along at least one seam region.

The coating can be made of polymer material for example and can be applied in a continuous or/and discrete coating pattern onto the fabric-like substrate.

The fabric-like substrate can include a multiplicity of helically wound links extending essentially in a substrate transverse direction, said links mutually overlapping with loop-like regions and being joined together by an elongated fastener passed through the mutually overlapping loop-like regions.

Alternatively it is possible of course for the fabric-like substrate to include a fabric substrate with fabric loops provided in the end regions which are to be joined together in the seam region.

In order to provide a completely closed structure in the region of the coating on a fabric-like clothing integrated in a machine for producing web material even after a seam region is closed again after being opened for installation purposes, it is proposed in addition for the coating cut in the region of at least one seam region to be joined again, for example, by gluing, melting or ultrasonic welding.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
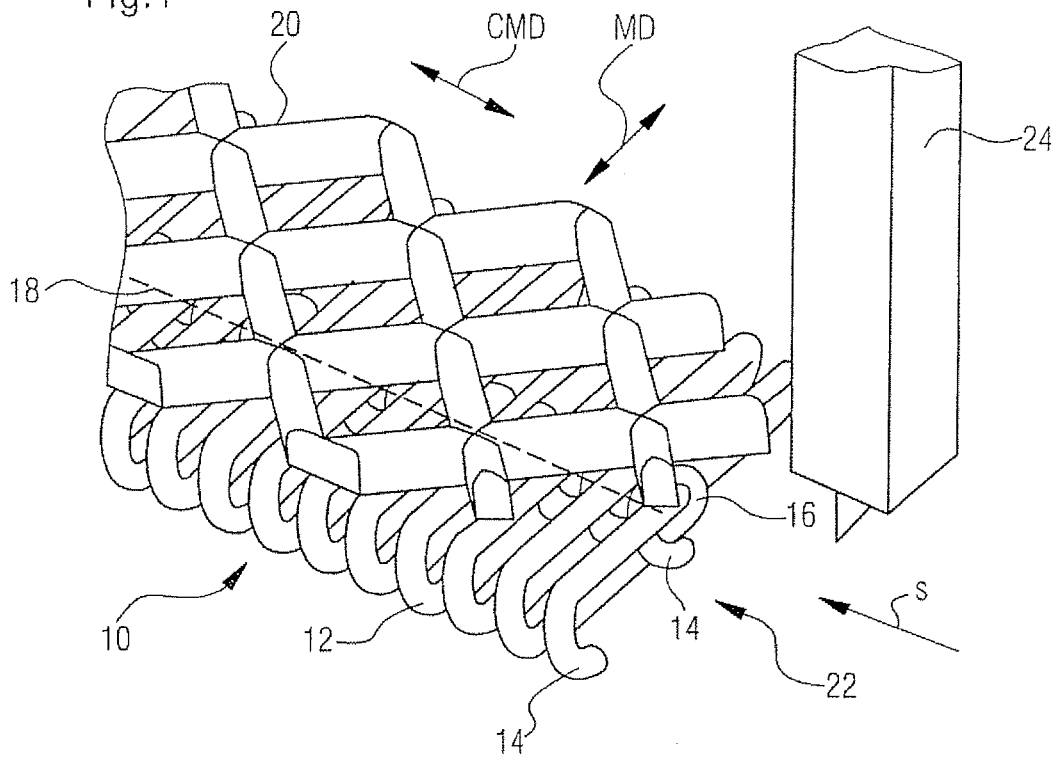
FIG. 1 shows a fabric-like substrate equipped with a coating in an intermediate phase of the manufacturing of a clothing for a machine for producing web material.

Referring now to the drawings, and more particularly to FIG. 1, there is shown a short section of a fabric-like substrate 10 for a web-like clothing for a machine for producing web material such as paper or paperboard. In the case of the construction evident in FIG. 1 the fabric-like substrate 10 is constructed as a spiral link fabric. Said spiral link fabric includes a multiplicity of links 12 which extend with their helically wound structure in a cross machine direction (CMD). The helical structure is flattened such that the individual windings form loops 14, 16 at their two end regions in the cross machine direction (CMD) and machine direction (MD) respectively. The loops 14 and 16 lying immediately adjacent each other in the cross machine direction (CMD) have a mutual distance which is also defined by the pitch of the winding and corresponds to at least the material thickness of the individual links 12. This way it is possible for the loops 14 from one of the links 12 to be engagingly positioned between the loops 16 or another link 12. An elongated fastener 18, which is constructed for example of wire material or the like and indicated schematically in FIG. 1 by a dashed line, can be inserted into the thus overlappingly arranged links 12. Said fastener 18 thus creates a hinge-like or jointed connection between directly adjacent links 12. The mutual distance between said fasteners 18 in the machine direction (MD), which is somewhat smaller than the length of the individual links 12 in this direction, can lie in the range from around 3 mm to 4 mm, preferably around 3.5 mm.

To be able to influence the properties of the clothing constructed with such a substrate for a machine for producing web material it is possible, for example, to provide a coating 20 on that side of the fabric-like substrate with which the web material to be produced or the starting material therefor is to come into contact. Said coating 20 constructed for example with polymer material or generally with elastomer material can be applied with any pattern in known manner in a screen printing process, for example with a rotary screen, or in an extrusion process. In this case the quantity or/and the viscosity of the material for the coating 20 can be selected such that it penetrates in defined manner into the open structure of the fabric-like substrate 10, for example with a penetration depth of 5% to 100%. An incomplete penetration of the fabric-like substrate 10 enables an air current to form on the rear side of the coating 10 or inside the fabric-like substrate 10 constructed with an open structure.

The pattern with which the coating 20 is applied onto the fabric-like substrate 10 can take any form. As is evident from FIG. 1 it is possible to use a continuous pattern, for example with the net-like configuration shown. Of course it is also possible to select discrete patterns such as dot-like regions.

It is evident from FIG. 1 that the coating 20 also lies in that region in which there is a seam region 22 of the fabric-like substrate 10 created by the mutually overlapping loops 14, 16 and the fastener inserted therein. It should be noted that on such a fabric-like substrate 10 constructed with the links 12 evident in FIG. 1 it is possible in principle for each of the elongated fasteners to be constructed and inserted in the related loops such that it can be pulled out again in order to open the substrate 10 which otherwise is provided in an endless configuration. It is also possible of course for the fabric-like substrate 10 to be manufactured in another way, for example in a weaving process, in which case a respective seam region is then formed by loops formed in the end regions of the fabric-like substrate which are to be joined together. Also it is possible for such a fabric-like substrate 10 to be wound around winding spindles forming the loops in the end regions. Actually it should be noted that the inventive approach explained in more detail below can be used on any fabric-like substrate 10 on which a seam region is formed by there being two end regions of the substrate 10 to be joined together and by said regions being joined together by inserting for example an elongated fastener and being detached by removing said fastener.

Hence with the inventive approach the coating 20 is applied with its desired structure, for example in a state in which the substrate 10 is installed in its closed, meaning endless, configuration in a coating station. After the coating 20 is applied with a random pattern it is first possible for example for the material of the coating 20 to be hardened, possibly under the action of heat. Thereafter the coating 20 is cut through in the seam region 22 by a cutting tool 24 indicated schematically in FIG. 1. In this case the approach can be to determine exactly the path of the elongated fastener 18 or the seam region 22 by way of optical recording systems, for example optical detectors or cameras, and then to guide the tool 24 in relation to the substrate 10 with the coating 20 such that the coating 20 is cut through directly above the seam region 22 or the elongated fastener 18 extending therein. For this purpose the tool 24 is then moved in a cutting direction S, which will also correspond essentially to the cross machine direction (CMD). Furthermore, said cutting is performed such that only the coating 20 is cut through, leaving the underlying fabric-like substrate 10 undamaged.

Figure 2:
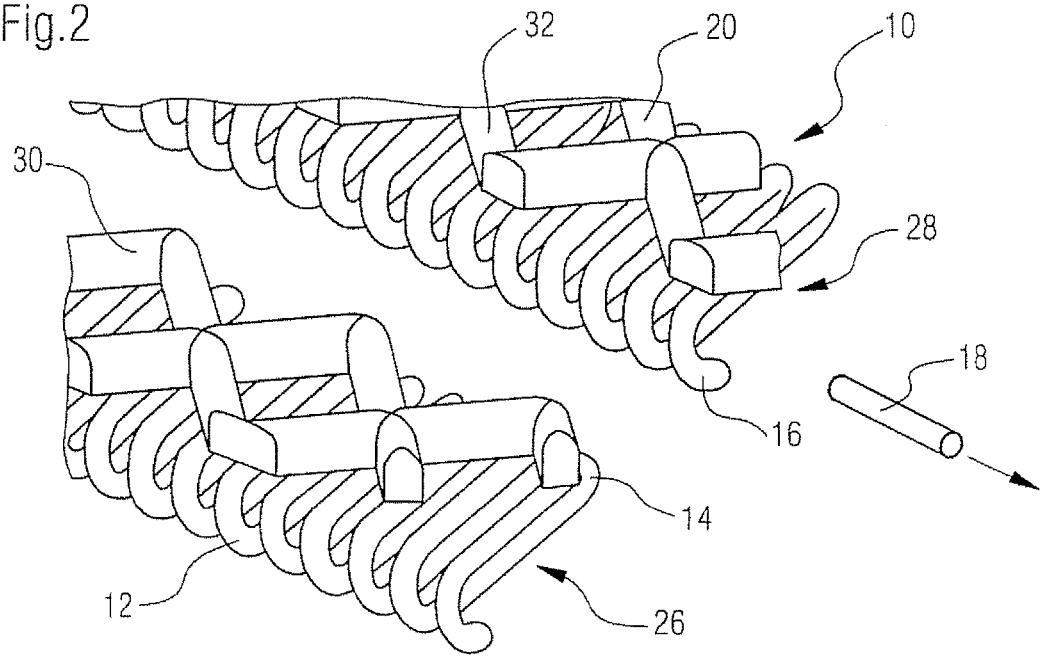
FIG. 2 shows a later phase of the manufacturing process.

After the fabric-like substrate 10 or the clothing constructed therewith is manufactured in this manner, the seam region 22 or at least one of the seam regions 22 can be opened in order to incorporate said substrate or clothing into a machine for producing web material. As is evident from FIG. 2, the elongated fastener 18 can be removed for this purpose from the region of the mutually overlapping loops 14, 16 such that the two end regions 26, 28 of the clothing or the substrate 10 can be moved apart from each other, revealing the previously formed cut region or cut in the coating 20.

After the clothing in open configuration has been incorporated into a machine for producing web material, the two end regions 26, 28 can again be positioned relative to each other such that the loops 14, 16 of the links 12 engage in each other or overlap, providing the space for receiving the elongated fastener 18. Said fastener can then be inserted again into this space in order in this manner to create again the closed, endless configuration of the clothing. In this state the two previously separated regions 30, 32 of the coating 20 again lie directly opposite each other and possibly touch each other. This means that in spite of the cut through the coating 20, there is a practically uninterrupted coating pattern of the coating 20 in the working state of the clothing thus manufactured. To intensify this effect further, the coating 20 can also be joined again in its directly adjacent regions 30, 32 after the clothing is incorporated into a machine for producing web material and the end regions 26, 28 are rejoined. This can take place for example by gluing or, in particular when using thermoplastic materials, by melting or ultrasonic welding. There then exists a completely closed structure of both the fabric-like substrate 12 and the coating 20.

From the above description it is clear that with the inventive approach and the inventive clothing it is possible to provide a coating with any pattern and of course a pattern made of any material. As already mentioned, it is advantageous to user elastomer material or polymer material, which can have optionally hydrophobic properties, hydrophilic properties or locally varying hydrophobic and hydrophilic properties and should withstand preferably temperatures of at least up to 250° C.

With an alternative approach for incorporating a clothing with a coating 20 constructed on a fabric-like substrate 10 into a machine for producing web material it is possible to proceed such that the clothing is incorporated in a closed, meaning endless, configuration should this be advantageous for example because of the constructional design of the particular machine for producing web material. It is then unnecessary to cut through the coating 20 in a seam region before the clothing is incorporated into such a machine. However, if the clothing is then to be removed for maintenance purposes and re-integrated into the machine, prior to its removal the coating 20 can be cut through in a seam region 22 by a suitable tool in order to be able to remove the clothing and then incorporate it again into the machine in the manner previously described. This means that the inventive measure c), above, can also be performed on a fabric-like clothing which was first integrated in a machine.

It should be noted that the previous description concerned the special advantages of the inventive approach and the inventive clothing in conjunction with the use of a machine for producing web material. It goes without saying that the preceding invention can be applied not only to fabric-like clothing of such machines for producing web material, for example paper machines. It can also be applied of course to any other industrial application in which such elongated clothing and clothing generally working in an endless configuration are used.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for manufacturing a papermachine clothing for a machine for producing a web of fibrous material, said method comprising the steps of: manufacturing the papermachine clothing, said step of manufacturing including the steps of:

(a) providing a fabric substrate with at least one seam region extending essentially in a substrate transverse direction, said fabric substrate including a spiral link fabric;

(b) applying a coating onto said fabric substrate such that said coating extends over said at least one seam region; and (c) cutting through said coating along said at least one seam region.

2. The method according to claim 1, wherein said coating is comprised of a polymer material.

3. The method according to claim 1, wherein said coating is applied with at least one of a continuous and a discrete coating pattern onto said fabric substrate.

4. The method according to claim 2, wherein said coating penetrates with a penetrating depth of 5% to 100% into said fabric substrate.

5. The method according to claim 1, wherein said at least one seam region of said fabric substrate includes, in two end regions of said fabric substrate lying in said at least one seam region, a plurality of mutually overlapping loops through which an elongated fastener extending essentially in said substrate transverse direction is passed in order to join said two end regions.

6. The method according to claim 5, wherein said spiral link fabric includes said plurality of mutually overlapping loops at said two end regions to be joined in said at least one seam region.

7. The method according to claim 5, characterized in that said step of cutting includes cutting through said coating along said elongated fastener.

8. The method according to claim 7, further comprising the steps of optically recording a path of said elongated fastener and guiding a cutting apparatus along said elongated fastener based on an optical record from said step of optically recording.

9. A method for installing a papermachine clothing into a machine for producing a web of fibrous material, said method comprising the steps of:

manufacturing the papermachine clothing, said step of manufacturing including the sub-steps of:

providing a fabric substrate with at least one seam region extending essentially in a substrate transverse direction, said fabric substrate including a spiral link fabric;

applying a coating onto said fabric substrate such that said coating extends over said at least one seam region; and cutting through said coating along said at least one seam region;

removing an elongated fastener from said at least one seam region of said fabric substrate;

incorporating the papermachine clothing into the machine for producing the web of fibrous material when the papermachine clothing is open; and closing said at least one seam region by inserting said elongated fastener into a plurality of mutually overlapping loops in a plurality of end regions of said fabric substrate which are to be joined together.

10. The method according to claim 9, further comprising the step of rejoining said coating cut along said at least one seam region after said step of cutting.

11. The method according to claim 10, wherein said step of rejoining includes one of gluing, melting, and ultrasonic welding of said coating which has been cut.

* * * * *